US010568467B2

(12) United States Patent
Enga et al.

(10) Patent No.: US 10,568,467 B2
(45) Date of Patent: Feb. 25, 2020

(54) LIQUID DISPENSER WITH FRAMED REFILL RECEIVING BAY

(71) Applicant: Conopco, Inc., Englewood Cliffs, NJ (US)

(72) Inventors: Agnete Enga, Oslo (NO); Ivan Exposito Sanchez, Valencia (ES); Jamie Mark Nicholson, Brooklyn, NY (US); Kevin Richard Lozeau, Charlotte, NC (US); Srinivasan Krishnan, New Canaan, CT (US)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 15/515,485

(22) PCT Filed: Oct. 1, 2015

(86) PCT No.: PCT/EP2015/072732
§ 371 (c)(1),
(2) Date: Mar. 29, 2017

(87) PCT Pub. No.: WO2016/050930
PCT Pub. Date: Apr. 7, 2016

(65) Prior Publication Data

US 2018/0168407 A1 Jun. 21, 2018

(30) Foreign Application Priority Data

Oct. 2, 2014 (EP) ..... 14187522

(51) Int. Cl.
*A47K 5/12* (2006.01)
*B05B 11/00* (2006.01)
(Continued)

(52) U.S. Cl.
CPC ..... *A47K 5/1204* (2013.01); *A47K 5/1217* (2013.01); *A47K 5/14* (2013.01);
(Continued)

(58) Field of Classification Search
CPC ..... A47K 5/1204; A47K 5/14; A47K 5/1217; A47K 5/12; A47K 5/1202; B05B 11/0054; B05B 11/3087; B05B 7/0018
(Continued)

(56) References Cited

U.S. PATENT DOCUMENTS 3,749,287 A * 7/1973 Sanders ..... G03G 15/104 222/181.2
4,511,395 A 4/1985 Misselbrook
(Continued)

FOREIGN PATENT DOCUMENTS

AR 032351 11/2003
CA 2762731 5/2013
(Continued)

OTHER PUBLICATIONS

Simplehuman, Simplehuman, 2013, http://www.simplehuman.co.uk/compact-sensor-pump-with-soap-sample-brushed-nickel-237-ml, ., US.
(Continued)

*Primary Examiner* — Paul R Durand
*Assistant Examiner* — Andrew P Bainbridge
(74) *Attorney, Agent, or Firm* — Gerard J. McGowan, Jr.

(57) ABSTRACT

A liquid dispenser has a bay surrounded by a shaped frame that is sized to receive a shaped refill inserted at an acute angle of 75 degrees or less in relation to the dispenser's lateral central axis. This unique arrangement is designed to maintain consistent quality of liquids dispensed by preventing the substitution of product refills having different shapes whose contents are of uncertain quality. Refills may be
(Continued)

readily manufactured and at low cost. Mechanical and motorized dispensers with optional proximity detection of a user's hand may be used with the inventive dispenser and refill arrangement. Liquid or foam may be dispensed depending on the design of the dispenser pump.

12 Claims, 5 Drawing Sheets

(51) Int. Cl.
*A47K 5/14* (2006.01)
*B05B 7/00* (2006.01)

(52) U.S. Cl.
CPC ..... *B05B 11/0054* (2013.01); *B05B 7/0018* (2013.01); *B05B 11/3087* (2013.01)

(58) Field of Classification Search
USPC ..... 222/63, 129, 154–159, 164–165, 182, 222/181.1, 185.1, 325–327
See application file for complete search history.

(56) References Cited

U.S. PATENT DOCUMENTS 4,967,935 A 11/1990 Celeste
4,989,755 A 2/1991 Shiau
D331,516 S 12/1992 Waring
D332,544 S 1/1993 Steiner et al.
5,235,214 A 8/1993 Vuong et al.
5,305,915 A 4/1994 Kamysz et al.
5,305,916 A 4/1994 Suzuki et al.
5,544,788 A 8/1996 Meyer
5,836,482 A 11/1998 Ophardt et al.
5,897,031 A * 4/1999 Wirt ..... A47K 5/1204 222/179
6,390,329 B1 5/2002 Maddox
6,467,651 B1 10/2002 Muderlak et al.
D471,047 S 3/2003 Gordon et al.
6,547,162 B1 4/2003 de Regt et al.
6,601,736 B2 8/2003 Ophardt et al.
D479,422 S 9/2003 Ciavarella et al.
6,726,061 B2 * 4/2004 Good ..... B67D 3/0009 222/105
7,025,227 B2 4/2006 Oliver et al.
7,063,239 B2 6/2006 Niada
D530,125 S 10/2006 Vignot
D530,126 S 10/2006 Reynolds et al.
D530,553 S 10/2006 Yang et al.
D531,440 S 11/2006 Lo
D531,845 S 11/2006 Christianson
D534,753 S * 1/2007 Christianson ..... D6/542
7,191,920 B2 3/2007 Boll et al.
7,246,722 B2 7/2007 Walters et al.
D554,408 S 11/2007 Scorgie
D554,409 S 11/2007 Scorgie
D564,273 S 3/2008 Yang et al.
D565,878 S 4/2008 Krus
D582,187 S 12/2008 Yang et al.
D608,578 S * 1/2010 Yang ..... D6/542
D612,741 S 3/2010 Miksovsky
D616,684 S 6/2010 Ciavarella et al.
D620,292 S 7/2010 Kim
D622,526 S 8/2010 Dai
7,766,194 B2 8/2010 Boll
D622,991 S 9/2010 MacDonald et al.
D626,365 S 11/2010 Yang et al.
D632,111 S 2/2011 MacDonald et al.
D634,142 S 3/2011 Meyerhoffer
7,997,187 B2 * 8/2011 Garman ..... A47J 31/0573 99/304
8,047,403 B2 11/2011 Quinlan et al.
8,056,768 B2 11/2011 Snodgrass
8,096,445 B2 1/2012 Yang et al.
8,109,411 B2 2/2012 Yang et al.
D658,915 S 5/2012 Fernandes et al.
D659,452 S * 5/2012 Yang ..... D6/542
D661,933 S 6/2012 DelGigante et al.
D662,743 S 7/2012 Meyerhoffer
D663,983 S 7/2012 Yang et al.
D665,610 S 8/2012 Kanfer et al.
D668,899 S * 10/2012 Buell ..... D6/545
D690,530 S 10/2013 Clough et al.
D699,048 S 2/2014 Paal et al.
D699,475 S 2/2014 Yang et al.
8,955,719 B2 2/2015 Li et al.
D732,307 S 6/2015 Enga et al.
D732,308 S * 6/2015 Enga ..... D6/542
9,204,765 B2 * 12/2015 McNulty ..... A47K 5/14
2003/0006246 A1 1/2003 Studer et al.
2003/0226853 A1 12/2003 Hidle et al.
2004/0060945 A1 4/2004 Cater et al.
2004/0149779 A1 * 8/2004 Boll ..... B05B 11/3057 222/333
2004/0226962 A1 11/2004 Mazursky et al.
2005/0224518 A1 10/2005 Walters et al.
2005/0224519 A1 10/2005 Law et al.
2005/0279783 A1 * 12/2005 Lo ..... B05B 9/0861 222/639
2006/0237483 A1 10/2006 Ophardt
2006/0243740 A1 11/2006 Reynolds et al.
2007/0051748 A1 3/2007 Yates et al.
2007/0241137 A1 10/2007 Willis et al.
2008/0185396 A1 * 8/2008 Yang ..... A47K 5/1217 222/52
2009/0108034 A1 4/2009 Bechyne et al.
2009/0140004 A1 * 6/2009 Scorgie ..... A47K 5/1217 222/52
2009/0200338 A1 8/2009 Quinlan et al.
2009/0200339 A1 8/2009 Quinlan et al.
2009/0200340 A1 8/2009 Ophardt et al.
2009/0294478 A1 12/2009 Ciavarella et al.
2009/0314806 A1 12/2009 Ray
2010/0051642 A1 3/2010 Wong et al.
2010/0059550 A1 3/2010 Ciavarella et al.
2010/0089951 A1 4/2010 Yates
2010/0102083 A1 4/2010 Quinlan
2010/0206306 A1 8/2010 Feriani et al.
2010/0213208 A1 8/2010 Bem et al.
2011/0014981 A1 1/2011 Mao et al.
2011/0017778 A1 1/2011 Kadiks et al.
2011/0024449 A1 2/2011 Walters et al.
2011/0095051 A1 4/2011 Liao et al.
2011/0101031 A1 5/2011 Hagleitner
2011/0114669 A1 5/2011 Yang et al.
2011/0156626 A1 6/2011 Mukai et al.
2011/0204096 A1 * 8/2011 Kessler ..... A47L 15/4454 222/129
2012/0048891 A1 * 3/2012 Hagleitner ..... A47K 5/16 222/52
2012/0097711 A1 4/2012 Xianzhi et al.
2012/0111884 A1 5/2012 Choi
2014/0027470 A1 * 1/2014 Pelfrey ..... B65D 21/086 222/105
2014/0138402 A1 * 5/2014 Warren ..... A47K 5/1202 222/2

FOREIGN PATENT DOCUMENTS

CN 301902763 5/2012
CN 302000073 7/2012
CN 203914723 11/2014
DE 102011015918 10/2011
DE 102011057069 6/2013
EP 10191671 1/1986
EP 0468062 11/1997
EP 2127580 12/2009
EP 2324744 5/2011
IN 234596 12/2011
TW D137497 10/2010
WO WO9415516 7/1994
WO WO2008049854 5/2008

(56) References Cited

FOREIGN PATENT DOCUMENTS

| | | |
|---|---|---|
| WO | 2008095187 | 8/2008 |
| WO | WO2011004184 | 1/2011 |
| WO | WO2011133085 | 10/2011 |
| WO | WO2011135336 | 11/2011 |
| WO | WO2011135338 | 11/2011 |
| WO | WO2012056220 | 5/2012 |
| WO | WO14050373 | 4/2014 |
| WO | WO2016050930 | 4/2016 |

OTHER PUBLICATIONS

IPRP2 in PCTEP2015072732, Jan. 17, 2017.
Search Report & Written Opinion in PCTEP2015072732, dated Dec. 11, 2015.
Search Report and Written Opinion in EP14187522, dated Mar. 25, 2015.
Van Minnen, Dettol's touch-less soap dispenser, Dettol Lysol soap pump, Nov. 22, 2012, http://tech-tech-news.blogspot.co.uk/2012/11/dettols-touch-less-soap-dispenser.html, ., US.
Written Opinion in PCTEP2015072732, dated Aug. 25, 2016.
Muse; Muse No-Touch Foam Hand Soap; PP1-4, Retrieved from the internet on Aug. 25, 2016, https://www.dca-design.com/work/rb-muse-foaming-handsoap.
Lysol No-Touch Hand Soap with Moisturizing Aloe & Vitamin E; Lysol No-Touch Hand Soap with Moisturizing Aloe & Vitamin E; PP1-5, Retrieved from the Internet on Aug. 25, 2016 (jet.com), http://bit.ly/2btfkjk.
Muse Foaming Handsoap; DCA Design International; PP1-3, Retrieved from the internet on Aug. 25, 2016, https://www.dca-design.com/work/rb-muse-foaming-handsoap.

* cited by examiner

LIQUID DISPENSER WITH FRAMED REFILL RECEIVING BAY

FIELD OF THE INVENTION

The invention relates to a liquid dispenser and specifically to one having a refill that is easily replaced via removal and insertion of the refill at an acute angle of 75 degrees or less with the dispenser's lateral central axis.

DESCRIPTION OF THE RELATED ART

Motorized and mechanical liquid dispensers are well known in the art. These dispensers have attempted to satisfy a number of criteria to be acceptable to consumers. These criteria include ease of dispensing, reliability of dispensing and ease in refilling the dispenser. When the dispenser is used to dispense a skin care or cleansing product, the user expects that the product dispensed will be of consistent and excellent quality for personal application to the skin. Manufacturers have sought to provide specific interfaces for refills for dispensers to assure the consumer that the product dispensed will be of the quality expected while minimizing production costs and providing easy replacement for the user. A brief representation of the references is set forth below.

U.S. Pat. No. 7,191,920 issued to Boll et al. on Mar. 20, 2007 discloses a liquid dispenser that may be variously refilled by insertion of a specifically shaped refill container, insertion of a bottle or manually refilled etc. in a complex arrangement U.S. Pat. No. 6,467,651 issued to Muderlak et al. on Oct. 22, 2002 discloses an automatic fluid soap dispensing apparatus where the replaceable reservoir and pump combination is mounted under the dispenser via a vertical male-female type connection.

However, these and other prior art devices do not incorporate a specifically shaped refill bay allowing for consistent operation, easy refill replacement, low cost of manufacture and a specific keyed arrangement to prevent the substitution of low quality liquids such as skin care and cleansing products without the desired properties that the user expects to find. As the perimeter of the inventive dispenser refill bay is a unique shape, an added benefit is that the user knows the refill is correct due to refill shape. Moreover when in the acute angle or near horizontal refill insertion facility, the refill is more protected in e.g. being dropped as it is substantially surrounded by the outer frame of the housing, as well as being less likely to dislodge. Furthermore the acute angle or near horizontal insertion facility limits possible abuse for over-forceful insertion as prior art vertical insertion allows the user to push down with possibly great force thereby deleteriously affecting the coupling means. Another advantage of the inventive dispenser includes the aesthetically pleasing appearance since the refill insertion within the dispenser provides a color or texture break for increased visual attraction

SUMMARY OF THE INVENTION

In one aspect of the invention is a liquid dispenser, including but not limited to:

a) a housing 20 having a height H and a central axis AA parallel to a housing bottom floor 44 and disposed at the midpoint of a housing height H; wherein the housing includes a first housing wall 22, a second housing wall 42 opposite the first housing wall 22, a shaped inner frame 90 having a first inner frame side 92 and a shaped outer frame 24; wherein the outer frame 24 connects the first housing wall 22 with the second housing wall 42;

b) wherein the housing contains a pump 26 configured for pumping fluid (80), wherein the pump 26 is connected to a pump inlet conduit 28 and a pump outlet conduit 30;

c) wherein housing 20 contains a refill bay 70 defined by shaped inner frame 90 and configured to receive a refill 60 that is inserted into refill bay 70 through first inner frame side 92 along either vector R or R' which vectors are both in the same plane defined by height H and axis AA and wherein both vectors intersect central axis AA on opposite sides at a point midway between first housing wall 22 and second housing wall 42; wherein vector R intersects central axis AA at an angle $\alpha$ between 0 and 75 degrees and vector R' intersects central axis AA at an angle $\alpha'$ between 0 and minus 75 degrees; and d) wherein refill 60 includes outlet interface 48 in fluid communication with refill reservoir 40 and wherein the refill interface 48 and a pump inlet conduit interface 53 are configured to sealingly engage with each other when refill 60 is fully inserted into refill bay 70.

In another aspect of the invention is a liquid dispenser kit including but not limited to:

i. a housing 20 having a height H and a central axis AA parallel to a housing bottom floor 44 and disposed at the midpoint of a housing height H; wherein the housing includes a first housing wall 22, a second housing wall 42 opposite the first housing wall 22, a shaped inner frame 90 having a first inner frame side 92 and a shaped outer frame 24; wherein the outer frame 24 connects the first housing wall 22 with the second housing wall 42;

ii. wherein the housing contains a pump 26 configured for pumping fluid (80), preferably in the range of 9 to 41° C. and 1 Atm., wherein the pump 26 is connected to a pump inlet conduit 28 and a pump outlet conduit 30;

iii. wherein housing 20 contains a refill bay 70 defined by shaped inner frame 90 and configured to receive a refill 60 that is inserted into refill bay 70 through first inner frame side 92 along either vector R or R' which vectors are both in the same plane defined by height H and axis AA and wherein both vectors intersect central axis AA on opposite sides at a point midway between first housing wall 22 and second housing wall 42; wherein vector R intersects central axis AA at an angle $\alpha$ between 0 and 75 degrees and vector R' intersects central axis AA at an angle $\alpha'$ between 0 and minus 75 degrees; and iv. wherein refill 60 includes outlet interface 48 in fluid communication with refill reservoir 40 and wherein the refill interface 48 and a pump inlet conduit interface 53 are configured to sealingly engage with each other when refill 60 is fully inserted into refill bay 70; and b. wherein refill 60 contains a composition including but not limited to:

i. 1 to 60% by wt. of one or more lathering surfactant(s) selected from soap, synthetic anionic surfactant(s), amphoteric surfactant(s), nonionic surfactant(s), cationic surfactant(s) or a blend thereof;

ii. 10 to 99% by wt. of water; and iii. optionally 0.1 to 30% by wt. of one or more skin conditioning agent(s) selected from hydrophobic conditioning agent(s), hydrophilic conditioning agent(s) or a bend thereof.

DETAILED DESCRIPTION OF THE INVENTION

All publications and patent applications, patents, and other references mentioned herein are incorporated by reference in their entirety.

Figure 1:
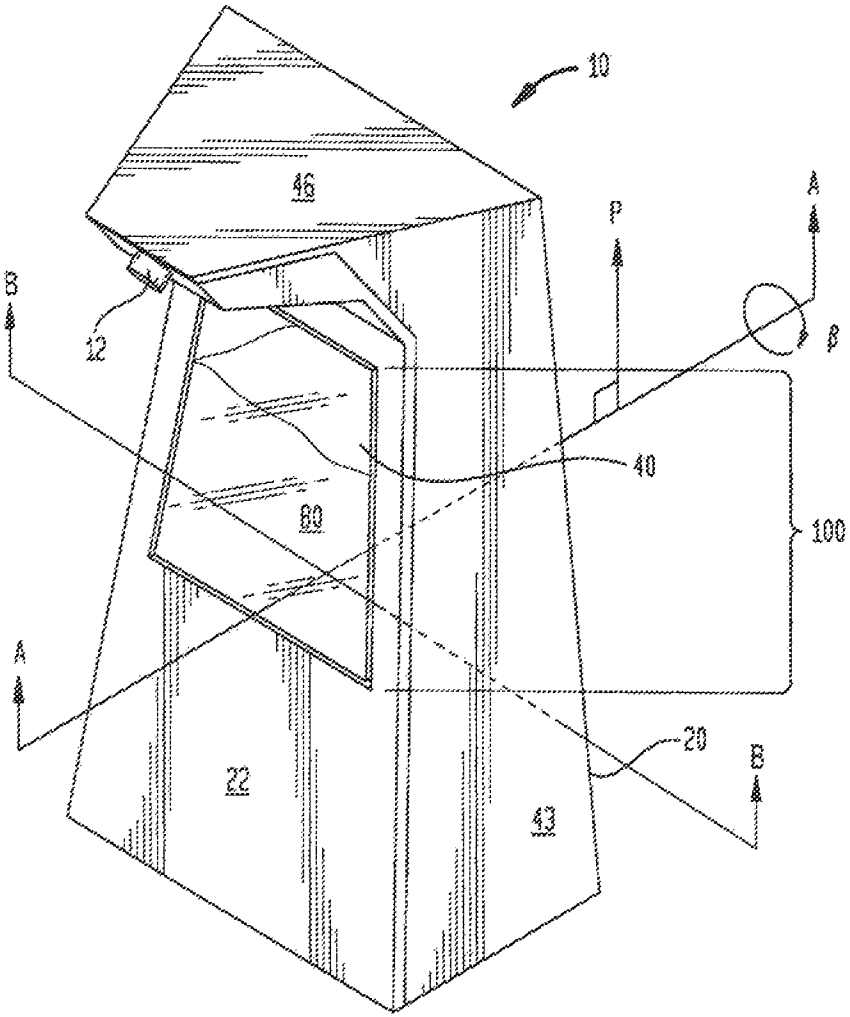
FIG. 1 is a front perspective view of a preferred aspect of the liquid dispenser showing the refill fully inserted in the dispenser.
Figure 3:
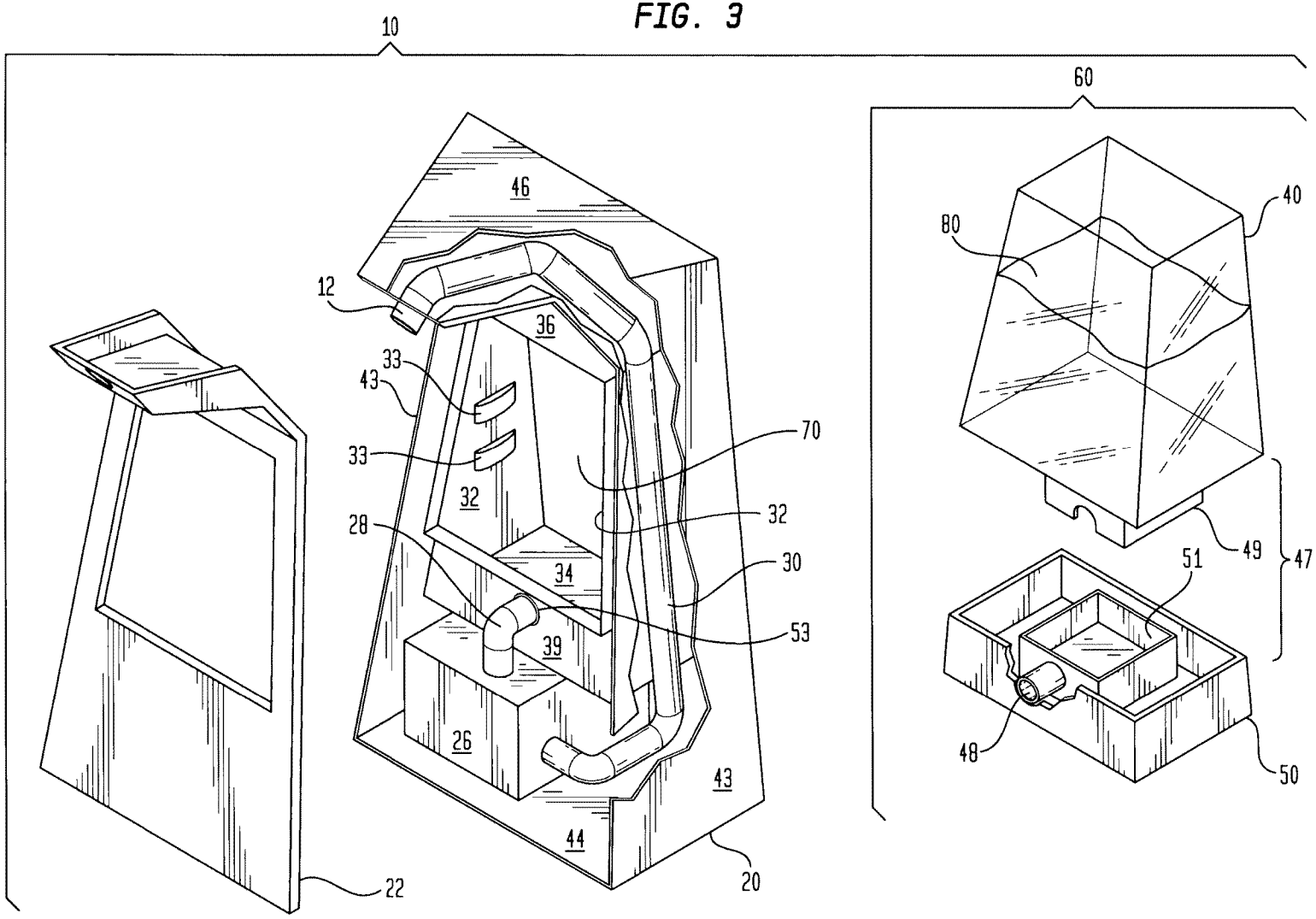
FIG. 3 is an exploded front perspective view of the dispenser of FIGS. 1 and 2, parts being broken away for clarity.
Figure 4:
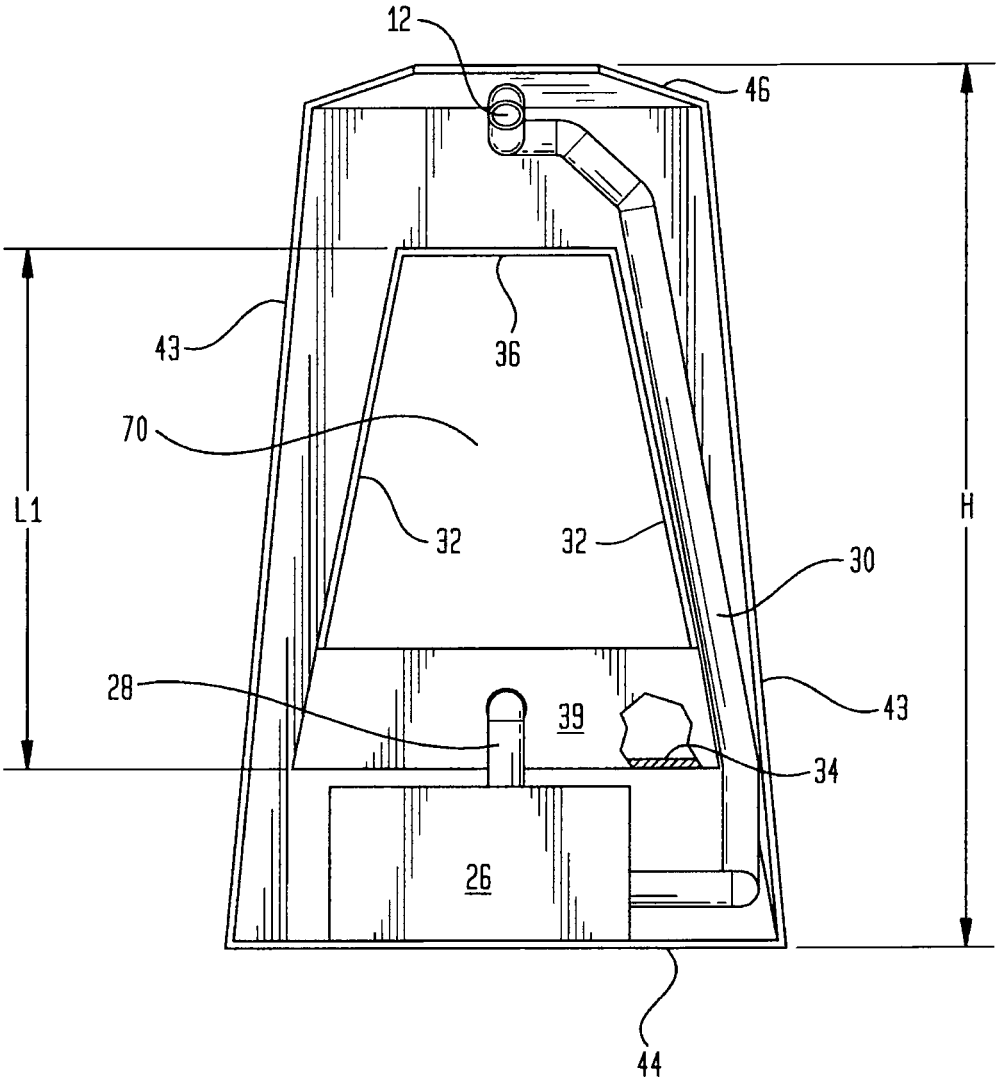
FIG. 4 is a front elevational cross-sectional view of the dispenser taken along line B-B in FIG. 1.
Figure 6:
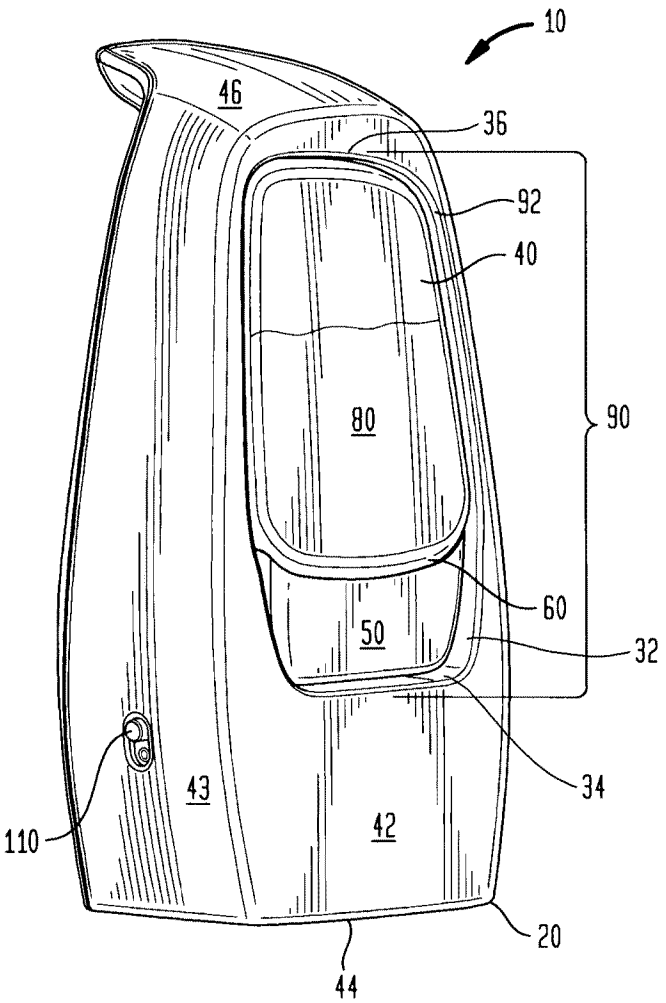
FIG. 6 is an elevational view of the left and back sides of the dispenser of FIG. 5.
Figure 5:
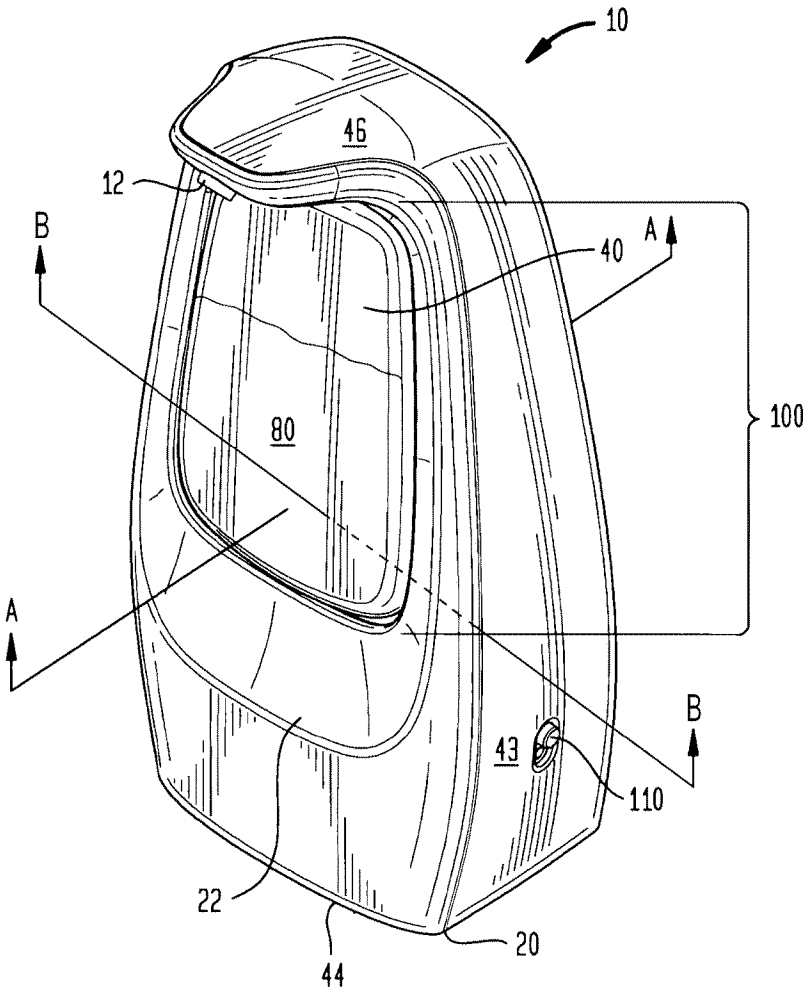
FIG. 5 is a front perspective view of a second preferred aspect of the liquid dispenser showing the refill fully inserted in the dispenser.

Referring now to the drawings in which like figures represent like elements, in FIG. 1, dispenser 10 is shown with refill 60 comprising reservoir 80 and refill base 50 fully inserted in refill bay 70 within the dispenser. Refill 60 may have its reservoir and refill base associated as a unitary structure or as separate components as illustrated in FIG. 3 where reservoir is shown connected to base 50 via coupling 47 where spout 49 sealingly engages receptacle 51 establishing fluid communication between fluid 80 and outlet interface 48. Any suitable coupling means may be used to sealingly engage reservoir 80 with outlet interface 48. The dispenser of FIG. 1 has outlet 12 at its front, front wall 22 and opposite rear wall 42 connected to the front wall via side walls 43, top wall 46 and bottom wall 44. In the preferred aspect illustrated in FIGS. 5 and 6, front wall 22 is connected to rear wall 42 via side walls 43 with smooth boundaries to form a contiguous smooth curved surface. In this aspect housing floor 44 is shown as flat but may also be curved and the dispenser may supported by legs or other supporting structure to provide stability. In the preferred aspect illustrated in FIGS. 7 and 8, front wall 22 is connected to rear wall 42 via outer frame 24 in the figurative shape of an apple when viewed along central axis AA. However outer frame 24 and inner frame 90 may take the form of any regular or irregular shape that may be the same or different and the refill 60 will preferably be of a complementary shape at least to inner frame 90.

Figure 2:
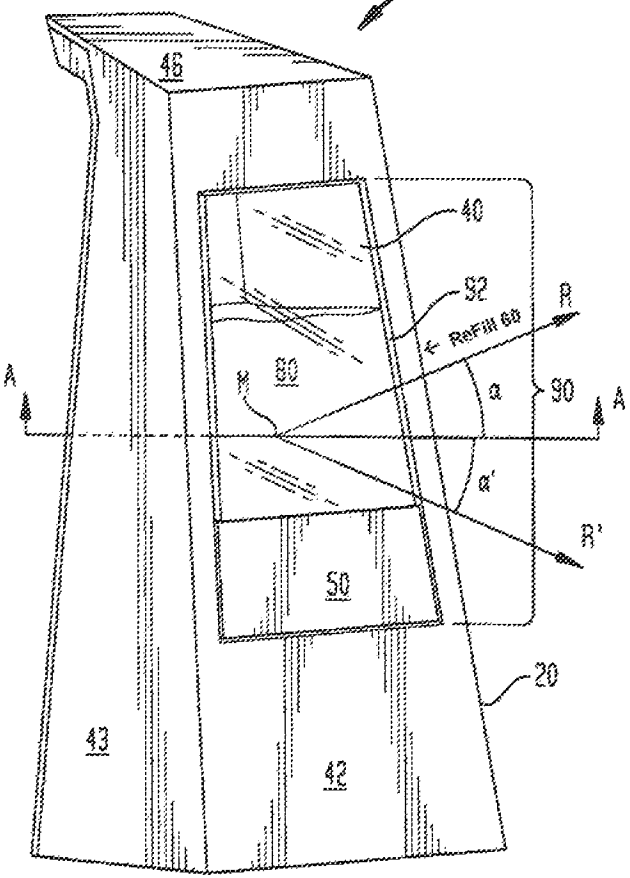
FIG. 2 is an elevational view of the left and back sides of the dispenser of FIG. 1.

As depicted in FIGS. 1 to 4, refill 60 is inserted into dispenser 10 into refill bay 70 defined by inner frame 90 via first inner frame side 92 until refill outlet interface 48 becomes sealingly engaged with pump inlet interface 53 i.e. is fully inserted. First inner frame side 92 is located at the back of the dispenser as can be seen in FIG. 2. Refill bay 70 is defined by inner frame 90 consisting of side walls 32, bottom wall 34 and top wall 36 collectively in the form of a polygon. Inner frame 90 may also have a regular or irregular curved shape as depicted in FIGS. 5 to 8. In similar fashion, refill 60 will be inserted into refill bay 70 via first inner frame side 92 in the aspects depicted in FIGS. 5 to 8 until refill outlet interface 48 becomes sealingly engaged with pump inlet interface 53. Optionally bulkhead 39 may further define refill bay 70 as depicted in FIG. 3. Preferably one or more inner frame protuberances 33 or equivalents thereof are employed to pressingly fit against and secure refill 60 inside the refill bay 70. Additionally a positive mechanical locking mechanism (not shown) may be used to releasably secure refill 60 inside refill bay 70.

Figure 8:
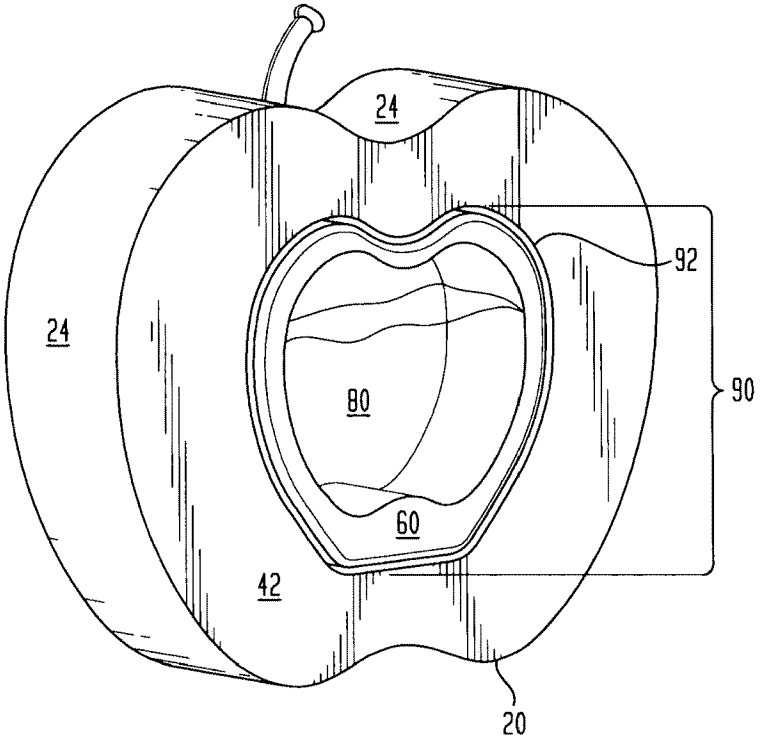
FIG. 8 is an elevational view of the left and back sides of the dispenser of FIG. 7.
Figure 7:
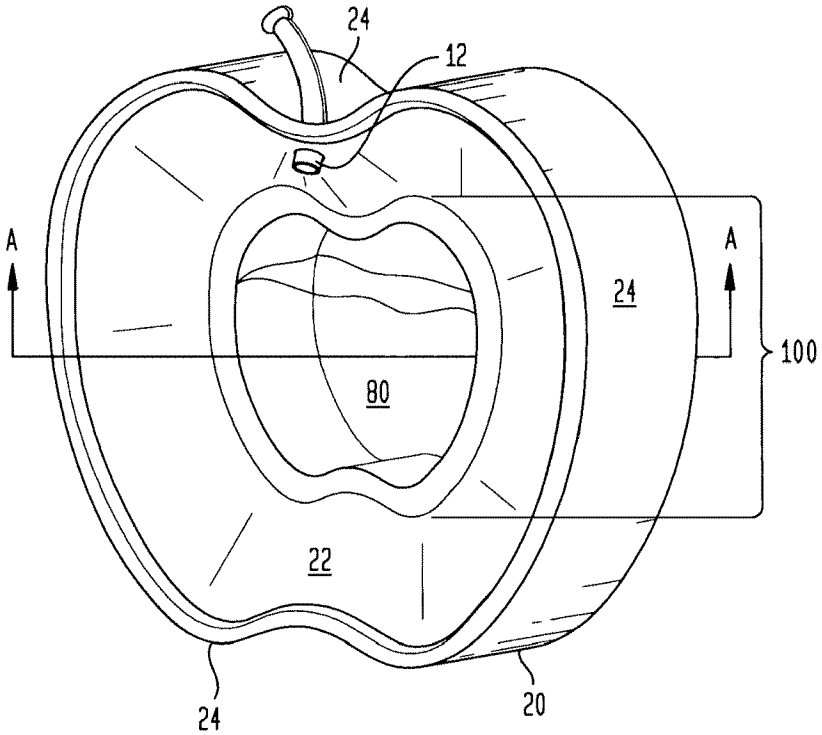
FIG. 7 is a front perspective view of a third preferred aspect of the liquid dispenser showing the refill fully inserted in the dispenser.

In a preferred aspect, inner frame 90 depicted in FIGS. 7 and 8 or the combination of inner frame walls 32, 34 and 36 depicted in FIGS. 1 to 6 is spaced apart from the outer frame 24 or from outer housing walls 43, 44 and 46 respectively over an angle of rotation $\beta$ of line P which is perpendicular with central axis AA as illustrated in FIG. 1. Angle $\beta$ is advantageously in the range of 120 to 360 degrees. This space between the inner and outer frames may be advantageously used to accommodate pump 26, pump inlet conduit 28, pump outlet conduit 30, mechanical and/or electrical pump actuators, their ancillary controls, a battery storage compartment or electric line voltage step down transformer and optionally other components that are useful for dispenser operation. Optionally the dispenser may have one or more remote proximity sensors such as a through beam, reflective or diffuse photo electric sensor, capacitive, inductive, Doppler effect, RF or ultrasonic sensor or equivalents thereof for detecting a user's hands in proximity to the outlet 12 and automatically activating pump 26 for a predetermined period of time the user's hands are detected and preferably deactivating the pump 26 when the hands are no longer detected.

Complementary shaped refill 60 is inserted into refill bay 70 along either vector R where vector R intersects central dispenser axis AA at dispenser midpoint M at angle $\alpha$ or along vector R' where vector R' intersects central dispenser axis AA at dispenser midpoint M at angle $\alpha'$ as illustrated in FIG. 2. Refills 60 are similarly inserted in the additional preferred aspects of dispenser 10 depicted in FIGS. 5 to 8 along analogous vectors R and R' (not shown). Angle $\alpha$ is in the range of 0 to 75 degrees. Preferably $\alpha$ is less than 50, 40, 30, 20, 10, 5, 4, 3, 2 or 1 degree(s). Similarly angle $\alpha'$ is in the range of 0 to minus 75 degrees. Preferably $\alpha'$ is less than minus 50, 40, 30, 20, 10, 5, 4, 3, 2 or 1 degree(s).

Optionally, the dispenser 10 has a window 100 to allow a user to monitor the amount of fluid 80 remaining in refill 60.

The window may be a simple aperture or include a transparent or translucent window preferably made of transparent or translucent plastic in whole or in part.

In operation of the dispenser 10 illustrated in FIGS. 1 to 4, after refill 60 is fully inserted into refill bay 70 within housing 20 (e.g. as illustrated in FIGS. 1 and 2), fluid 80 will fluidly communicate with pump inlet conduit 28 and pump inlet conduit interface 53 via outlet interface 48. Upon actuation of pump 26 via either a hydraulic, pneumatic, electric or a mechanical actuator (not shown) or any combination or equivalent thereof, fluid 80 will be pumped through pump outlet conduit 30 and outlet 12 into the hands of a user or other receptacle upon activation of e.g. switch 110. Pump 26 may comprise any device capable of moving fluid 80 to outlet 12, preferably at a temperature in the range of 9 to 42 C and 1 Atm pressure. Preferably pump 25 includes any positive displacement pump arrangement known in the art including 1) rotary-type positive displacement such as internal gear, screw, shuttle block, flexible vane or sliding vane, circumferential piston, flexible impeller, helical twisted roots or liquid ring vacuum pumps; 2) reciprocating-type positive displacement such as piston, peristaltic or diaphragm pumps; 3) linear-type positive displacement such as rope pumps and chain pumps or any combination or an equivalent thereof for pumping a flowable fluid. Optionally an air or other gas may be entrained in liquid 80 to produce an air or other gas entrained liquid foam that is dispensed via outlet 12. Any suitable method may be employed for such gas entrainment including but not limited to the use of one or more screens, swirl chambers, venturis, nebulizers, bubble diffusers, spargers or the like and equivalents thereof.

In one aspect of the invention is a liquid dispenser, including but not limited to:

A liquid dispenser (10) for dispensing a fluid (80), including:

a. a housing 20 having a height H and a central axis AA parallel to a housing bottom floor 44 and disposed at the midpoint of a housing height H; wherein the housing includes a first housing wall 22, a second housing wall 42 opposite the first housing wall 22, a shaped inner frame 90 having a first inner frame side 92 and a shaped outer frame 24; wherein the outer frame 24 connects the first housing wall 22 with the second housing wall 42;

b. wherein the housing contains a pump 26 configured for pumping fluid (80), preferably in the range of 9 to 41° C. and 1 Atm., wherein the pump 26 is connected to a pump inlet conduit 28 and a pump outlet conduit 30;

c. wherein housing 20 contains a refill bay 70 defined by shaped inner frame 90 and configured to receive a refill 60 that is inserted into refill bay 70 through first inner frame side 92 along either vector R or R' which vectors are both in the same plane defined by height H and axis AA and wherein both vectors intersect central axis AA on opposite sides at a point midway between first housing wall 22 and second housing wall 42; wherein vector R intersects central axis AA at an angle $\alpha$ between 0 and 75 degrees and vector R' intersects central axis AA at an angle $\alpha'$ between 0 and minus 75 degrees; and d. wherein refill 60 includes outlet interface 48 in fluid communication with refill reservoir 40 and wherein the refill interface 48 and a pump inlet conduit interface 53 are configured to sealingly engage with each other when refill 60 is fully inserted into refill bay 70.

Advantageously angle $\alpha$ is between 0 and 70, 65, 60, 55, 50, 45, 40, 35, 30, 25, 20, 15, 10, 5, 2, 1, 0.5 or 0.1 degrees and angle $\alpha'$ is between 0 and minus 70, 65, 60, 55, 50, 45, 40, 35, 30, 25, 20, 15, 10, 5, 2, 1, 0.5 or 0.1 degrees.

Advantageously the outer frame 24 and inner frame 90 are spaced apart over an arc defined by at least a 120 degree angle of rotation 3 around the central axis AA of a line P drawn perpendicular to axis AA. Preferably 3 is at least 150, 180, 210, 240, 270, 300, 330 or 360 degrees.

Preferably refill 60 has a transparent or translucent refill reservoir 40. More preferably pump 26 has an entrainment mechanism which entrains air or gas into fluid 80. Most preferably refill reservoir 40 is sealingly engaged via a liquid tight coupling 47 to refill adapter 50 and refill adapter 50 includes refill interface 48 in fluid communication with refill reservoir 40, preferably the coupling comprises spout 49 and receptacle 51 or an equivalent liquid tight connection.

Preferably the junction between wall 22 and outer frame 24 and between wall 42 and outer frame 24 comprise a smooth, three dimensional surface, preferably without noticeable boundaries or seams. Advantageously the first inner frame side 92 when viewed along central axis AA has a regular or irregular shape, more preferably wherein the first inner frame side shape is selected from a polygonal, circular, ovoidal, curved or curvilinear shape or a combination thereof.

Preferably first housing wall 22 defines an open, transparent or translucent window 100 coinciding with at least a portion of refill reservoir 40, preferably with a vertical cross-section of refill reservoir 40.

Advantageously refill 60 passes into refill bay 70 either on the side of the dispenser 10 where dispenser outlet 12 is located or on the opposite side of the dispenser 10 where dispenser outlet 12 is located. Preferably the refill bay 70 is sized to receive the refill 60 in pressing engagement with the inner frame 90, preferably refill 60 has a refill reservoir 40 whose volume is under 1 liter or 500 mls. More preferably refill bay 70 is sized to receive the refill assembly 60 in pressing engagement via a plurality of protuberances 33 rigidly connected to the inside frame and extending into the refill bay.

Advantageously refill bay 70 is further defined by a bulkhead 39 connected to the inner frame 90 opposite the first inner frame side 92.

In another aspect of the invention is a liquid dispenser kit including but not limited to:

a. a liquid dispenser (10) for dispensing a fluid (80), including:

i. housing 20 having a height H and a central axis AA parallel to a housing bottom floor 44 and disposed at the midpoint of a housing height H; wherein the housing includes a first housing wall 22, a second housing wall 42 opposite the first housing wall 22, a shaped inner frame 90 having a first inner frame side 92 and a shaped outer frame 24; wherein the outer frame 24 connects the first housing wall 22 with the second housing wall 42;

ii. wherein the housing contains a pump 26 configured for pumping fluid (80), preferably in the range of 9 to 41° C. and 1 Atm., wherein the pump 26 is connected to a pump inlet conduit 28 and a pump outlet conduit 30;

iii. wherein housing 20 contains a refill bay 70 defined by shaped inner frame 90 and configured to receive a refill 60 that is inserted into refill bay 70 through first inner frame side 92 along either vector R or R' which vectors are both in the same plane defined by height H and axis AA and wherein both vectors intersect central axis AA on opposite sides at a point midway between first housing wall 22 and second housing wall 42; wherein vector R intersects central axis AA at an angle $\alpha$ between 0 and 75 degrees and vector R' intersects central axis AA at an angle $\alpha'$ between 0 and minus 75 degrees; and iv. wherein refill 60 includes outlet interface 48 in fluid communication with refill reservoir 40 and wherein the refill interface 48 and a pump inlet conduit interface 53 are configured to sealingly engage with each other when refill 60 is fully inserted into refill bay 70; and b. wherein refill 60 contains a composition including but not limited to:

i. 1 to 60% by wt. of one or more lathering surfactant(s) selected from soap, synthetic anionic surfactant(s), amphoteric surfactant(s), nonionic surfactant(s), cationic surfactant(s) or a blend thereof; Preferably the lathering surfactants include a blend of soap(s) and synthetic anionic surfactant(s) in the concentration range of 5 to a maximum of 10, 15 and 20% by wt. Preferably the lathering surfactants include an amphoteric surfactant in the concentration range of 1 to a maximum of 5, 7, and 10% by wt.

ii. 10 to 99% by wt. of water; and iii. optionally 0.1 to 30% by wt. of one or more skin conditioning agent(s) selected from hydrophobic conditioning(s), hydrophilic conditioning (s) or a bend thereof. Preferably hydrophilic conditioning agents in the total concentration range of 5 to 15 by wt. Preferably hydrophilic conditioning agents include polyols such as glycerin and propylene glycol. Preferably the hydrophobic conditioning agent(s) is/are less than 5, 4, 3, 2, 1, 0.5, 0.1, or 0.01% by wt. or may be absent.

Lathering Surfactant

The inventive liquid dispenser kit contains a liquid cleansing composition with lathering surfactant(s). By a "lathering surfactant" is meant a surfactant, which when combined with water and mechanically agitated generates a foam or lather. Preferably, these lathering surfactants should be mild, which means that they must provide sufficient cleansing or detersive benefits but not overly dry the skin or hair, and yet meet the lathering criteria described above.

A wide variety of lathering surfactants is useful herein and include those selected from anionic, nonionic, cationic, and amphoteric surfactants and mixtures thereof.

Among the anionic lathering surfactants useful herein are the following non-limiting examples which include the classes of:

(1) Alkyl benzene sulfonates in which the alkyl group contains from 9 to 15 carbon atoms, preferably 11 to 14 carbon atoms in straight chain or branched chain configuration. Especially preferred is a linear alkyl benzene sulfonate containing 12 carbon atoms in the alkyl chain.

(2) Alkyl sulfates obtained by sulfating an alcohol having 8 to 22 carbon atoms, preferably 12 to 16 carbon atoms. The alkyl sulfates have the formula $ROSO_3$-$M^+$ where R is the $C_{8-22}$ alkyl group and M is a mono- and/or divalent cation.

(3) Paraffin sulfonates having 8 to 22 carbon atoms, preferably 12 to 16 carbon atoms, in the alkyl moiety. These surfactants are commercially available as Hostapur SAS from Hoechst Celanese.

(4) Olefin sulfonates having 8 to 22 carbon atoms, preferably 12 to 16 carbon atoms. Most preferred is sodium $C_{14}$-$C_{16}$ olefin sulfonate, available as Bioterge AS 40®

(5) Alkyl ether sulfates derived from an alcohol having 8 to 22 carbon atoms, preferably 12 to 16 carbon atoms, ethoxylated with less than 30, preferably less than 12, moles of ethylene oxide. Most preferred is sodium lauryl ether sulfate formed from 1 or 2 moles average ethoxylation, commercially available as e.g. Standopol ES-2®.

(6) Alkyl glyceryl ether sulfonates having 8 to 22 carbon atoms, preferably 12 to 16 carbon atoms, in the alkyl moiety.

(7) Fatty acid ester sulfonates of the formula: $R^1CH(SO_3$-M+)$CO_2R^2$ where $R^1$ is straight or branched alkyl from $C_8$- to $C_{18}$, preferably $C_{12}$ to $C_{16}$, an $R^2$ is straight or branched alkyl from $C_1$ to $C_6$, preferably primarily $C_1$, and M+ represents a mono- or divalent cation.

(8) Secondary alcohol sulfates having 6 to 18, preferably 8 to 16 carbon atoms.

(9) Fatty acyl isethionates having from 10 to 22 carbon atoms, with sodium cocoyl isethionate being preferred.

(10) Dialkyl sulfosuccinates wherein the alkyl groups range from 3 to 20 carbon atoms each.

(11) C10 to C14 Acyl glycinates. Most preferred is sodium or potassium cocoyl glycinate.

(12) Alkanoyl sarcosinates corresponding to the formula $RCON(CH_3)CH_2CH_2CO_2M$ wherein R is alkyl or alkenyl of 10 to 20 carbon atoms and M is a water-soluble cation such as ammonium, sodium, potassium and trialkanolammonium. Most preferred is sodium lauroyl sarcosinate.

(13) Alkyl lactylates wherein the alkyl groups range from 8 to 18 carbon atoms, with sodium lauryl lactylate sold as Pationic 138 C® available from the Patterson Chemical Company as the most preferred.

(14) Taurates having from 8 to 16 carbon atoms, with cocoyl methyl taurate being preferred.

(15) Fatty acid soaps consisting of soluble soaps. Soluble soap is defined as a soap or soap blend having a Krafft point less than or equal to 40 C. The soluble soap(s) can be selected from the chain length of C6-C14 saturated fatty acid soap(s) and C16-C18 unsaturated and polyunsaturated fatty acid soap(s) or a combination of these fatty acid soaps. These soluble soaps can be derived from coco fatty acid, Babasu fatty acid, palm kernel fatty acid and any other source of unsaturated fatty acid including tallow and vegetable oils and their mixtures.

Nonionic lathering surfactants suitable for the present invention include $C_{10}$-$C_{20}$ fatty alcohol or acid hydrophobes condensed with from 2 to 100 moles of ethylene oxide or propylene oxide per mole of hydrophobe; $C_2$-$C_{10}$ alkyl phenols condensed with from 2 to 20 moles of alkylene oxides; mono- and di-fatty acid esters of ethylene glycol such as ethylene glycol distearate; fatty acid monoglycerides; sorbitan mono- and di-$C_8$-$C_{20}$ fatty acids; and polyoxyethylene sorbitan available as Polysorbate 80 and Tween 80° as well as combinations of any of the above surfactants.

Other useful nonionic surfactants include alkyl polyglycosides, saccharide fatty amides (e.g. methyl gluconamides) as well as long chain tertiary amine oxides. Examples of the latter category are: dimethylododecylamine oxide, oleyldi (2-hydroxyethyl)amine oxide, dimethyloctylamine oxide, dimethyldecylamine oxide, dimethyltetradecylamine oxide, di(20-hydroxyethyl)tetradecylamine oxide, 3-didodecyoxy-2-hydroxypropyldi(3-hydroxypropyl)amine oxide, and dimethylhexadecylamine oxide.

Suitable amphoteric or zwitterionic lathering surfactants for use in the present compositions include those broadly described as derivatives of aliphatic quaternary ammonium, phosphonium, and sulfonium compounds, wherein which the aliphatic radicals can be straight chain or branched, and wherein one of the aliphatic substituents contains 8 to 30 carbon atoms and another substituent contains an anionic water-solubilizing group, such as carboxy, sulfonate, sulfate, phosphate, phosphonate, and the like. Classes of zwitterionics include alkylamino sulfonates, alkyl betaines and alkylamido betaines, such as stearamidopropyldimethylamine, diethylaminoethylstearamide, dimethylstearamine, dimethylsoyamine, soyamine, myristylamine, tridecylamine, ethylstearylamine, N-tallowpropane diamine, ethoxylated (5 moles ethylene oxide) stearylamine, dihydroxy ethyl stearylamine, arachidylbehenylamine, and the like. Some suitable betaine surfactants include but are not limited to alkyl betaines, alkyl amidopropyl betaines, alkyl sulphobetaines, alkyl glycinates, alkyl carboxyglycinates, alkyl amphopropionates, alkyl amidopropyl hydroxysultaines, acyl taurates, and acyl glutamates, wherein the alkyl and acyl groups have from 8 to 18 carbon atoms. Non-limiting examples of preferred amphoteric surfactants include cocamidopropyl betaine, sodium cocoamphoacetate, disodium cocoamphodiacetate, cocamidopropyl hydroxysultaine, and sodium cocoamphopropionate, which are particularly suitable as mild-type cleansers for skin and hair.

Hydrophilic Conditioning Agents

Skin hydrophilic conditioning agents also known as hydrophilic emollients may be advantageously used in the present invention as benefit agents. The emollient "composition" may be a single agent component or it may be a mixture of two or more compounds one or all of which may have a conditioning aspect. In addition, the conditioning agent itself may act as a carrier for other components one may wish to add to the personal care implement.

Hydrophilic emollients are preferably present in a concentration range of 2 to 20% by weight of the cleansing composition contained in the refill. The term "emollient" is defined as a substance which softens or improves the elasticity, appearance, and youthfulness of the skin (stratum corneum) by either increasing its water content, adding, or replacing lipids and other skin nutrients; or both, and keeps it soft by retarding the decrease of its water content.

Useful examples of hydrophillic emollients (also known as humectants) include polyhydric alcohols, e.g. glycerine and propylene glycol, and the like; polyols such as the polyethylene glycols listed below and the like; saccharide(s) and/or polysaccharide(s) such as sucrose, sorbitol; and urea derivatives such as hydroxyethyl urea and the like may be advantageously used.

Other useful examples of hydrophillic emollients include any of the following or blends thereof: alcaligenes polysaccharides; algae extract; aloe barbadensis leaf extract; *Bacillus*/rice bran extract/soybean extract ferment filtrate; black strap powder; diglycereth-7 malate; diglycerin; diglycol guanidine succinate; erythritol; fructose; glucose; glucoronolactone; glycereth-7 glycolate; glycerin; glyceryl dimaltodextrin; glycol; hesperetin laurate; 1,2,6-hexanetriol; honey; hydrogenated honey; hydrogenated starch hydrolysate; hydrolyzed wheat protein/PEG-20 acetate copolymer; hydroxypropyltrimonium hyaluronate; inositol; lactic acid; lacitol; maltitol; maltose; mannitol; mannose; methoxy PEG-7; methoxy PEG-10; methoxy PEG-16; methoxy PEG-25; methoxy PEG-40; methoxy PEG-100; PEG 4; PEG-6; PEG-7; PEG-8; PEG-9; PEG-10; PEG-12; PEG-14; PEG-16; PEG-18; PEG-20; PEG-32; PEG-40; PEG-45; PEG-55; PEG-60; PEG-75; PEG-90; PEG-75; PEG-90; PEG-100; PEG-135; PEG-150; PEG-180; PEG-200; PEG-220; PEG-240; PEG-800; PEG-15 butanediol; PEG-3-methyl ether; PEG-4 methyl ether; PEG-5 pentaerythrityl ether; polyglyceryl sorbitol; potassium dextrin octenylsuccinate; potassium PCA; PPG-6 sorbeth-245; PPG-6 sorbeth-500; propylene glycol; *Rosa canina* seed extract; sodium acetylated hyaluronate; sodium dextrin octenylsuccinate; sodium glucuronate; sodium PCA; sorbeth-6; sorbeth-20; sorbeth-30; sorbeth-40; sorbitol; sorbityl silanediol; sucrose; TEA dextrin octenylsuccinate; trehalose; triglycereth-7 citrate; trioxaundecanedioic acid; tripropylene glycol; urea; urea-d-glucuronic acid; xylitol; xylose and the like.

Hydrophobic Conditioning Agents

Hydrophobic conditioning agents are defined herein as either "finely dispersed or emulsified oils" and/or agents with very low water solubility as defined below and are optionally present at total levels of less than 20, 10, 5, 3, 2, 1, 0.5, 0.1 or 0.01% by wt. in the composition contained in the inventive kit and may be absent from the composition. These hydrophobic conditioning agents include but are not limited to the following:

(a) silicone oils and modifications thereof such as linear and cyclic polydimethylsiloxanes; amino, alkyl, alkylaryl, and aryl silicone oils;
(b) fats and oils including natural fats and oils (triglycerides) such as jojoba, soybean, sunflower, rice bran, avocado, almond, olive, sesame, persic, castor, coconut, mink oils; cacao fat; beef tallow, lard; hardened oils obtained by hydrogenating the aforementioned oils; and synthetic mono, di and triglycerides such as myristic acid glyceride and 2-ethylhexanoic acid glyceride;
(c) waxes such as carnauba, spermaceti, beeswax, lanolin, and derivatives thereof;
(d) hydrophobic plant extracts;
(e) hydrocarbons such as petrolatum, polybutene, liquid paraffins, microcrystalline wax, ceresin, squalene, pristan and mineral oil;
(f) higher alcohols such as lauryl, cetyl, stearyl, oleyl, behenyl, cholesterol and 2-hexydecanol alcohol;
(g) esters such as cetyl octanoate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactate, alkyl citrate and alkyl tartrate;
(h) essential oils and extracts thereof such as mentha, jasmine, camphor, white cedar, bitter orange peel, ryu, turpentine, cinnamon, bergamot, citrus unshiu, calamus, pine, lavender, bay, clove, hiba, *eucalyptus*, lemon, starflower, thyme, peppermint, rose, sage, sesame, ginger, basil, juniper, lemon grass, rosemary, rosewood, avocado, grape, grapeseed, myrrh, cucumber, watercress, calendula, elder flower, geranium, linden blossom, amaranth, seaweed, ginko, *ginseng*, carrot, guarana, tea tree, jojoba, comfrey, oatmeal, cocoa, neroli, vanilla, green tea, penny royal, aloe vera, menthol, cineole, eugenol, citral, citronelle, borneol, linalool, geraniol, evening primrose, camphor, thymol, spirantol, penene, limonene and terpenoid oils;
(i) mixtures of any of the foregoing components, and the like.

Preferably hydrophobic conditioning agents have a very low solubility in water at 20 C. Preferably their water solubility is less than 0.5, 0.1, 0.05 or 0.01% by wt.

The foregoing description illustrates selected aspects of the present invention. In light thereof variations and modifications will be suggested to one skilled in the art, all of which are within the scope and spirit of this invention.

The invention claimed is:

1. A liquid dispenser (10) for dispensing a fluid (80), comprising:

a. a housing (20) having a height H and a central axis AA extending between side walls 43 parallel to a housing bottom floor (44) and disposed at the midpoint of the housing height H; wherein the housing includes a first housing wall (22), a second housing wall (42) opposite the first housing wall (22), a shaped inner frame (90) having a first inner frame side (92) and a shaped outer frame (24); wherein the outer frame (24) connects the first housing wall (22) with the second housing wall (42);

b. wherein the housing contains a pump (26) configured for pumping the fluid (80), wherein the pump (26) is connected to a pump inlet conduit (28) and a pump outlet conduit (30);

c. wherein the housing (20) contains a refill bay (70) defined by the shaped inner frame (90) and configured to receive a refill (60) comprising a refill reservoir (40) and a refill adapter (50) that is inserted into the refill bay (70) through the first inner frame side (92) at the rear of the dispenser along either the vector R or R' wherein the vector R and the vector $R^1$ are both in the same plane defined by the height H and the axis AA and wherein both vectors intersect the central axis AA on opposite sides at a point midway between the first housing wall (22) and the second housing wall (42); wherein the vector R intersects the central axis AA at an angle $\alpha$ between 0 and 75 degrees and the vector R' intersects the central axis AA at an angle $\alpha'$ between 0 and minus 75 degrees; and d. wherein the refill (60) includes an outlet interface (48) in fluid communication with the refill reservoir (40) and wherein the outlet interface (48) and a pump inlet conduit interface (53) are configured to sealingly engage with each other when the refill (60) is fully inserted into the refill bay (70), and wherein the refill is substantially surrounded by the outer frame, and wherein the refill (60) passes into the refill bay (70) on the opposite side of the dispenser (10) from where a dispenser outlet (12) is located, the dispenser outlet being located at the front of the dispenser.

2. The dispenser of claim 1 wherein the outer frame (24) and the inner frame (90) are spaced apart over an arc defined by at least a 120 degree angle of rotation $\beta$ around the central axis AA of a line P drawn perpendicular to the axis AA.

3. The dispenser of claim 1, wherein the angle $\alpha$ is less than 10 degrees.

4. The dispenser according to claim 1 wherein the refill reservoir (40) is transparent or translucent.

5. The dispenser of according to claim 1 wherein the pump (26) has an entrainment mechanism which entrains air or gas into the fluid (80) prior to dispensing.

6. The dispenser according to claim 1 wherein the refill reservoir (40) is sealingly engaged via a liquid tight coupling (47) to the refill adapter (50) and the refill adapter 50 includes a refill interface (48) in fluid communication with the refill reservoir (40).

7. The dispenser according to claim 1 wherein the junction between the first housing wall (22) and the outer frame (24) and between the second housing wall (42) and the outer frame (24) comprise a smooth, three dimensional surface.

8. The dispenser according to claim 1 wherein the first housing wall (22) defines an open, transparent or translucent window (100) coinciding with at least a portion of the refill reservoir (40).

9. The dispenser according to claim 1 wherein the refill bay (70) is sized to receive the refill (60) in a pressing engagement with the inner frame (90).

10. The dispenser according to claim 1 wherein the refill bay (70) is sized to receive the refill assembly (60) in a pressing engagement via a plurality of protuberances (33) rigidly connected to the inside frame and extending into the refill bay.

11. The dispenser according to claim 1 wherein the refill bay (70) is further defined by a bulkhead (39) connected to the inner frame 90 opposite the first inner frame side (92).

12. A liquid dispenser kit comprising:

a. A liquid dispenser according to claim 1; and b. a refill (60) containing a composition comprising:

i. 1 to 60% by wt. of one or more lathering surfactant(s) selected from soap, synthetic anionic surfactant(s), amphoteric surfactant(s), nonionic surfactant(s), cationic surfactant(s) or a blend thereof;

ii. 10 to 99% by wt. of water, and iii. 0.1 to 30% by wt. of one or more skin conditioning agent(s) selected from hydrophobic conditioning agent(s), hydrophilic conditioning agent(s) or a blend thereof.

* * * * *